US009174336B2

(12) United States Patent
Daranyi et al.

(10) Patent No.: US 9,174,336 B2
(45) Date of Patent: Nov. 3, 2015

(54) PANEL UNLOAD TABLE

(71) Applicant: Toyota Motor Engineering & Manufacturing North America, Inc., Erlanger, KY (US)

(72) Inventors: Gabe N. Daranyi, Kitchener (CA); Kerry S. Moniz, Dorchester (CA)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 209 days.

(21) Appl. No.: 13/872,206

(22) Filed: Apr. 29, 2013

(65) Prior Publication Data

US 2014/0318421 A1 Oct. 30, 2014

(51) Int. Cl.
*B25H 1/00* (2006.01)

(52) U.S. Cl.
CPC ..... *B25H 1/0007* (2013.01)

(58) Field of Classification Search
CPC ..... A47B 13/081; A47B 1/08; A47B 1/10; B25H 1/0007
USPC ..... 108/5, 28, 32, 138
See application file for complete search history.

(56) References Cited

U.S. PATENT DOCUMENTS 1,666,548 A * 4/1928 Anderson et al. ..... 108/75
1,831,174 A * 11/1931 Heule et al. ..... 108/75
1,916,648 A * 7/1933 Walter ..... 108/73
1,938,893 A * 12/1933 Cooper ..... 108/73
2,256,372 A * 9/1941 Chabon ..... 248/447
4,440,096 A * 4/1984 Rice et al. ..... 108/3
5,224,429 A * 7/1993 Borgman et al. ..... 108/147
5,271,320 A * 12/1993 Reneau ..... 100/147
5,379,816 A * 1/1995 Charlton ..... 144/287
5,669,314 A * 9/1997 Grant ..... 108/48
6,152,009 A * 11/2000 Jorgensen et al. ..... 83/761
6,269,753 B1 * 8/2001 Roddan ..... 108/50.01
6,471,461 B2 * 10/2002 Muilwyk ..... 414/276
7,395,765 B1 * 7/2008 Dorfman ..... 108/48
7,553,118 B1 * 6/2009 Doepker ..... 414/276
7,811,043 B2 * 10/2010 Anderson ..... 414/398
7,975,625 B2 7/2011 Topham et al.
8,418,591 B2 * 4/2013 Frolov ..... 83/477.2

FOREIGN PATENT DOCUMENTS

GB 190929128 A * 0/1910

* cited by examiner

*Primary Examiner* — Lee D Wilson
*Assistant Examiner* — Joel Crandall
(74) *Attorney, Agent, or Firm* — Christopher G. Darrow; Darrow Mustafa PC

(57) ABSTRACT

An apparatus and methods for unloading panels. One example method includes receiving the panel on a table top. The panel is positioned on the table top to allow a worker to make an external surface inspection. The method further includes rotating a table flap extending from the table top from a first position to a second position to allow a worker access to a panel fixture in a stowed position. The method further includes moving the panel fixture from the stowed position to a load position and receiving the panel on the panel fixture. The panel is positioned on the panel fixture to engage a load sensor. In response to the load sensor sensing the panel on the panel fixture, the method further includes rotating the panel fixture from the load position to an unload position.

18 Claims, 6 Drawing Sheets

PANEL UNLOAD TABLE

BACKGROUND

The manufacturing and assembly process for automotive vehicles requires workers to both inspect and handle various parts. Some sheet metal parts, including door panels, roof panels, fenders, decklids, and other body panels can be heavy, large, or unwieldy, making the body panels difficult to position on unload tables in a manner that is both suitable for inspection and ergonomically acceptable for storage and installation handling of the body panels.

SUMMARY

An apparatus and method for assisting workers in unloading panels in the vehicle manufacturing process.

In one implementation, a panel unload table apparatus is disclosed. The apparatus includes a table top; a table flap extending from the table top having a first position and a second position; and a panel fixture rotatable about a pivot axis and having: a stowed position substantially parallel to the table top; a load position substantially coplanar with the table top; and an unload position wherein the unload position is spaced angularly between the load position and the second position of the table flap.

In another implementation, a method for unloading a panel is disclosed. The method includes receiving the panel on a table top wherein the panel is positioned on the table top to allow a worker to make an external surface inspection; rotating a table flap extending from the table top from a first position to a second position to allow a worker access to a panel fixture in a stowed position; moving the panel fixture from the stowed position to a load position; receiving the panel on the panel fixture wherein the panel is positioned on the panel fixture to engage a load sensor; and in response to the load sensor sensing the panel on the panel fixture, rotating the panel fixture from the load position to an unload position.

In another implementation, a method for unloading a panel is disclosed. The method includes receiving the panel on a table top wherein the panel is positioned on the table top to allow a worker to make an external surface inspection; rotating a table flap extending from the table top from a first position substantially coplanar with the table top to a second position substantially perpendicular to the table top to allow a worker access to a panel fixture in a stowed position substantially parallel to the table top; moving the panel fixture from the stowed position to a load position substantially coplanar with the table top; receiving the panel on the panel fixture wherein the panel is positioned on the panel fixture to engage a load sensor; and in response to the load sensor sensing the panel on the panel fixture, rotating the panel fixture from the load position to an unload position spaced angularly between the load position and the second position of the table flap.

BRIEF DESCRIPTION OF THE DRAWINGS

The description herein makes reference to the accompanying drawings wherein like reference numerals refer to like parts throughout the several views, and wherein.

DETAILED DESCRIPTION

A panel unload table and methods for unloading panels using the panel unload table are described here. The panel unload table includes a table flap extending from and rotatably coupled to a table top. The panel unload table also includes a panel fixture stowed below the table top which can be extended and raised into a load position substantially coplanar with the table top when the table flap is in a folded position. The panel fixture includes a load sensor and rotary actuator which can rotate the panel, such as a door panel, fender panel, decklid, or other body panel, from the table top to a substantially vertical position to assist a worker in unloading the panel from the panel unload table in an ergonomic position.

Figure 1:
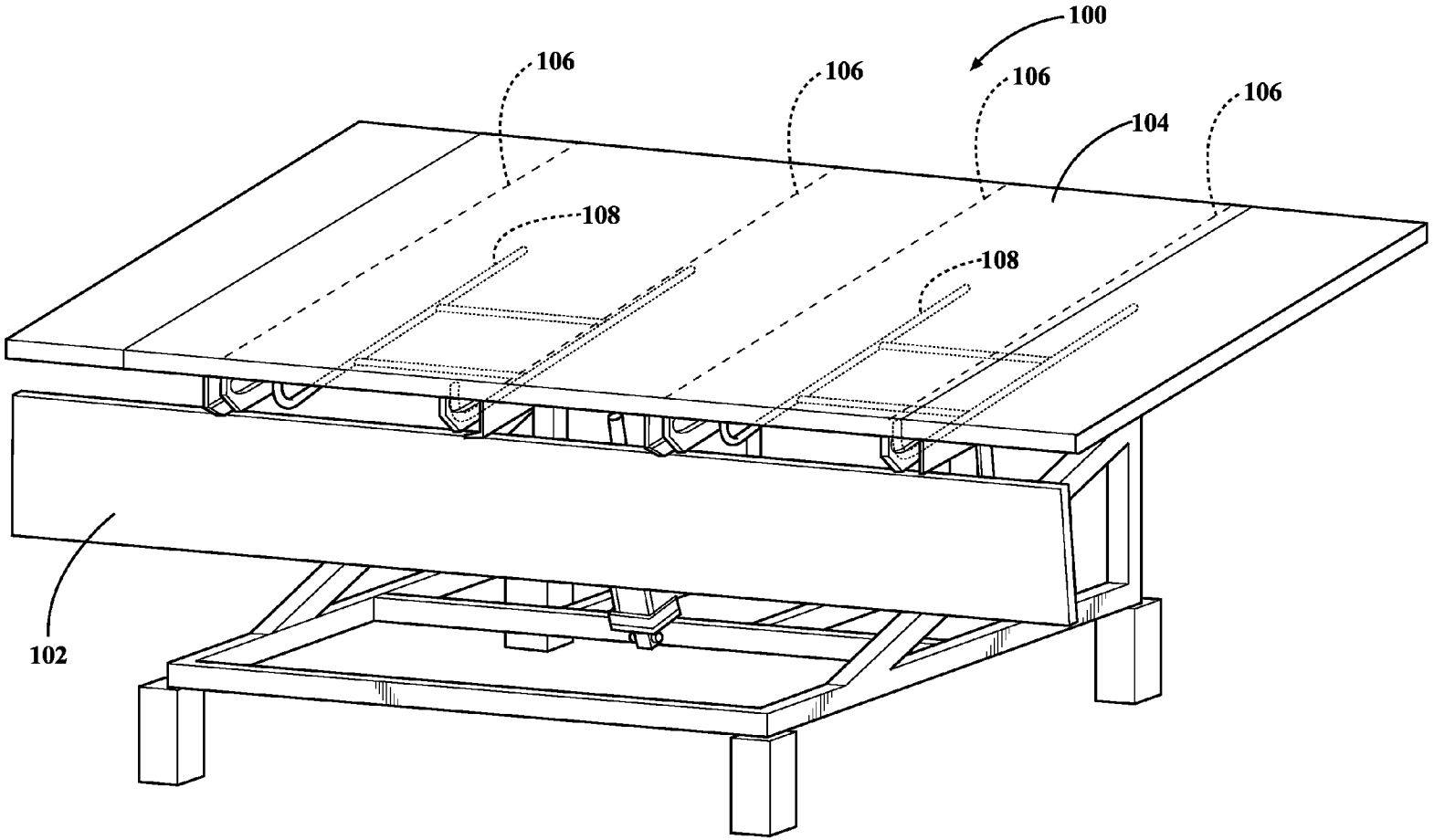
FIG. 1 is a perspective view of a panel unload table with the table flap in a folded position.

FIG. 1 is a perspective view of a panel unload table 100 with a table flap 102 in a folded position. The table flap 102 can both extend from a table top 104 and be rotatably coupled to the table top 104, for example, using hinges. The table flap 102 can have a first position substantially coplanar with the table top 104. The first position of the table flap 102 can, for example, put the outer surface of the table flap 102 in the same plane as the outer surface of the table top 104. When the table flap 102 is in the first position, the upper surface of the table top 104 and the table flap 102 can be used as a single planar surface, for example, as a work surface for inspection or storage of large body panels in an automotive assembly plant.

The table flap 102 can also have a second position, such as the folded position shown in FIG. 1. The second position of the table flap 102 can be substantially perpendicular to the table top 104. For example, the table flap 102 can be rotated approximately 90 degrees between the first position and the second position, allowing a worker unfettered access to a lower surface of the table top 104 as well as shortening the upper surface of the table top 104. Additional hardware useful in assisting workers in unloading body panels from the panel unload table 100 can be affixed to the lower surface of the table top 104.

For example, one or more pairs of slide rails 106 can be disposed on the lower surface of the table top 104. Additionally, a panel fixture 108 can be slidably disposed between a pair of slide rails 106. Each pair of slide rails 106 can store a panel fixture 108 fixture in a stowed position with the stowed position being substantially parallel to the table top 104 and at the same time below the lower surface of the table top 104. Each panel fixture 108 in its stowed position can be accessed by a worker when the table flap 102 is in the second, folded position.

Figure 2:
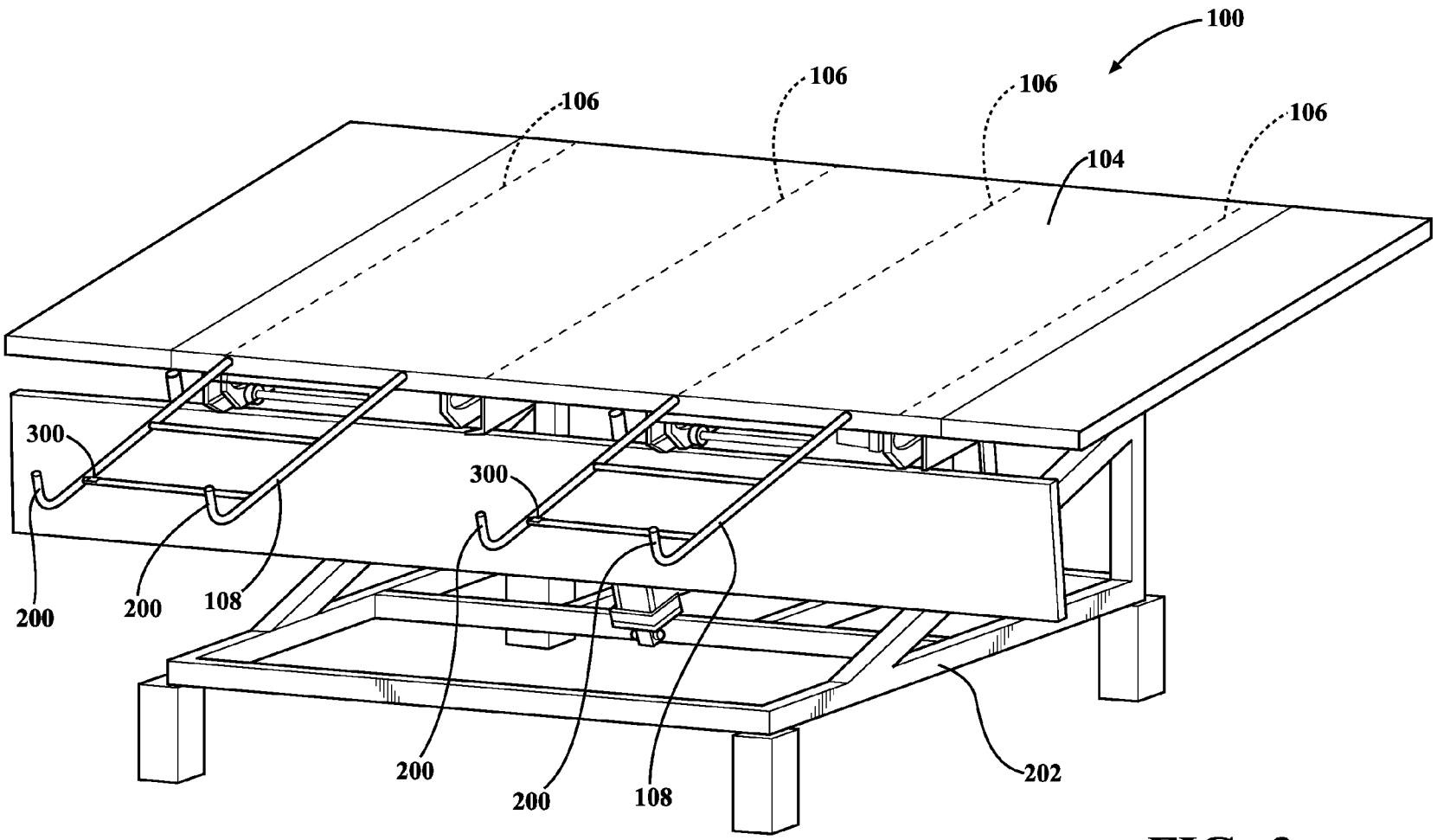
FIG. 2 is a perspective view of the panel unload table of FIG. 1 with a pair of panel fixtures in a load position.

FIG. 2 is a perspective view of the panel unload table 100 of FIG. 1 with a pair of panel fixtures 108 in a load position. The load position can be substantially coplanar with the table top 104. By creating a near continuous surface with the panel fixtures 108 and the table top 104, a worker can easily move a body panel from the table top 104 to one or more of the panel fixtures 108. This can be accomplished by sliding the body panel along to table top 104 onto one or more of the panel fixtures. One or more stop surfaces 200 can be disposed at one end of the panel fixtures 108 for stopping the motion of the body panel when sliding the panel from the table top 104 to one or more of the panel fixtures 108.

A worker can move each panel fixture 108 from the stowed position as shown in FIG. 1 to the load position shown in FIG. 2 by sliding each panel fixture 108 along its respective pair of slide rails 106. This action is simplified by using one or more of the stop surfaces 200 at the end of the panel fixtures 108. The stop surfaces 200 can be located on the end of the panel fixtures 108 nearest to the junction between the table flap 102 and table top 104. A worker can guide the panel fixture 108 along its respective pair of slide rails 106 by grasping one or more of the stop surfaces 200 and pulling or pushing the panel fixture 108 in the desired direction.

The panel unload table 100 can also include a table base 202. The table top 104 can be rotatably coupled to the table base 202 to allow adjustments in the inclination or the height of the table top 104. For example, the table top 104 can be a tilt-table top which is raised and lowered along the path of an arc to change the position and inclination of the table top 104 in respect to the table base 202. Allowing for various positions of the table top 104 can assist workers in sliding body panels along the table top to the panel fixtures 108 and account for the different physical characteristics between different workers, e.g., different heights or strengths.

Figure 3:
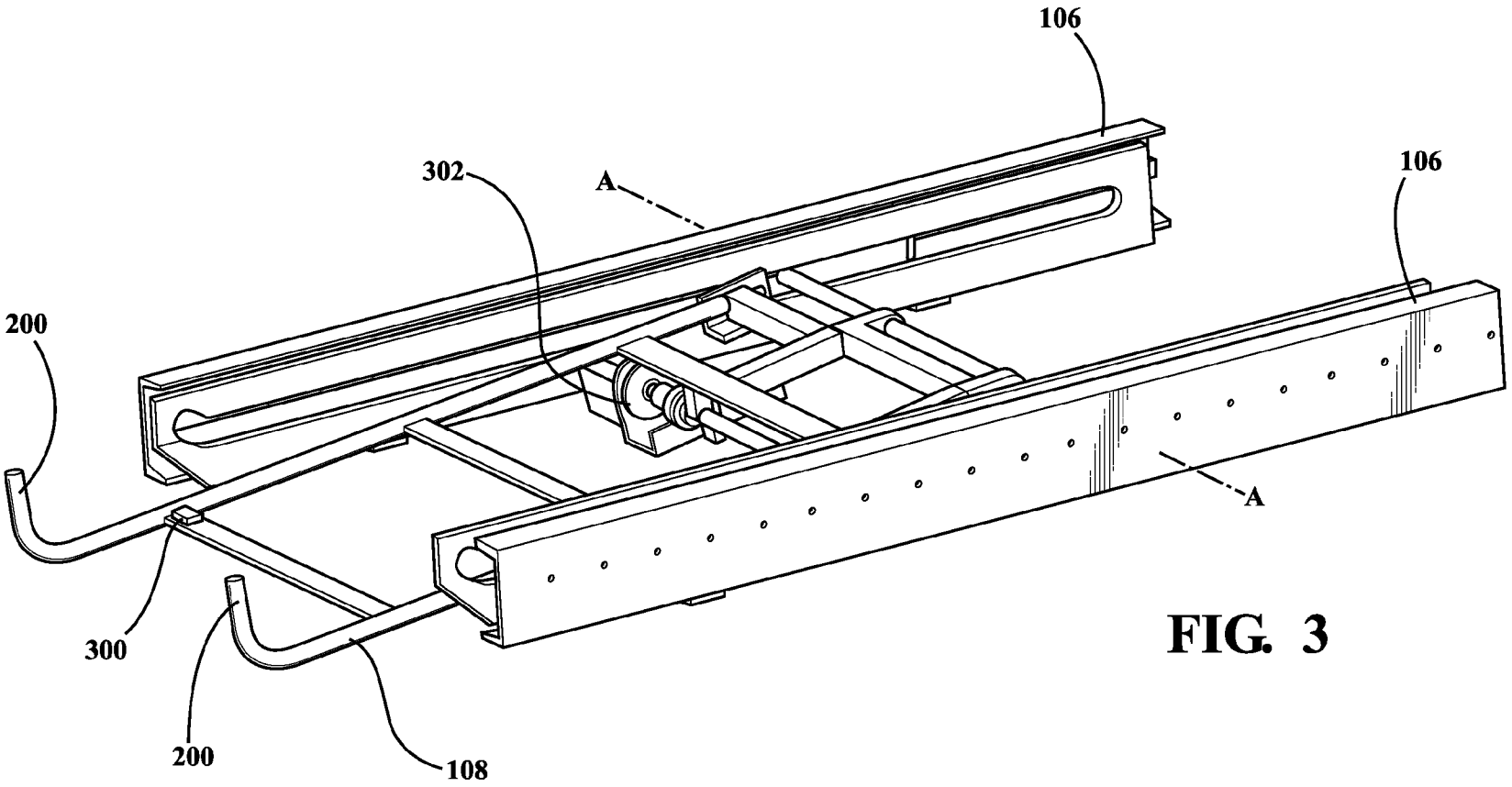
FIG. 3 is a perspective view of one of the panel fixtures of FIGS. 1 and 2 disposed between a pair of slide rails.

FIG. 3 is a perspective view of one of the panel fixtures 108 of FIGS. 1 and 2 disposed between a pair of slide rails 106. In addition to including stop surfaces 200 at one end, the panel fixture 108 can be rotatable about a pivot axis A-A. Allowing the panel fixture 108 to pivot about axis A-A can assist a worker in sliding the panel fixture 108 from the stowed position, as shown in FIG. 3, to the load position shown in FIG. 2. A cam-follower mechanism, or any other mechanism, can also be used to lock the panel fixture 108 in the load position once the panel fixture 108 reaches the end of its travel path at the end of the slide rails 106.

The panel fixture 108 can also include a load sensor 300 and a rotary actuator 302. Once a body panel has been moved from the table top 104 to the panel fixture 108 in the load position, the load sensor 300, for example, a pneumatic switch or other sensor capable of recognizing the presence of a body panel, can send a signal to the rotary actuator 302 to rotate the panel fixture 108 about the pivot axis A-A. The rotary actuator 302 can cause the panel fixture 108 to move the body panel from the load position to an unload position. The panel fixtures 108 are shown in the unload position (without body panels in place) in FIG. 4.

Figure 4:
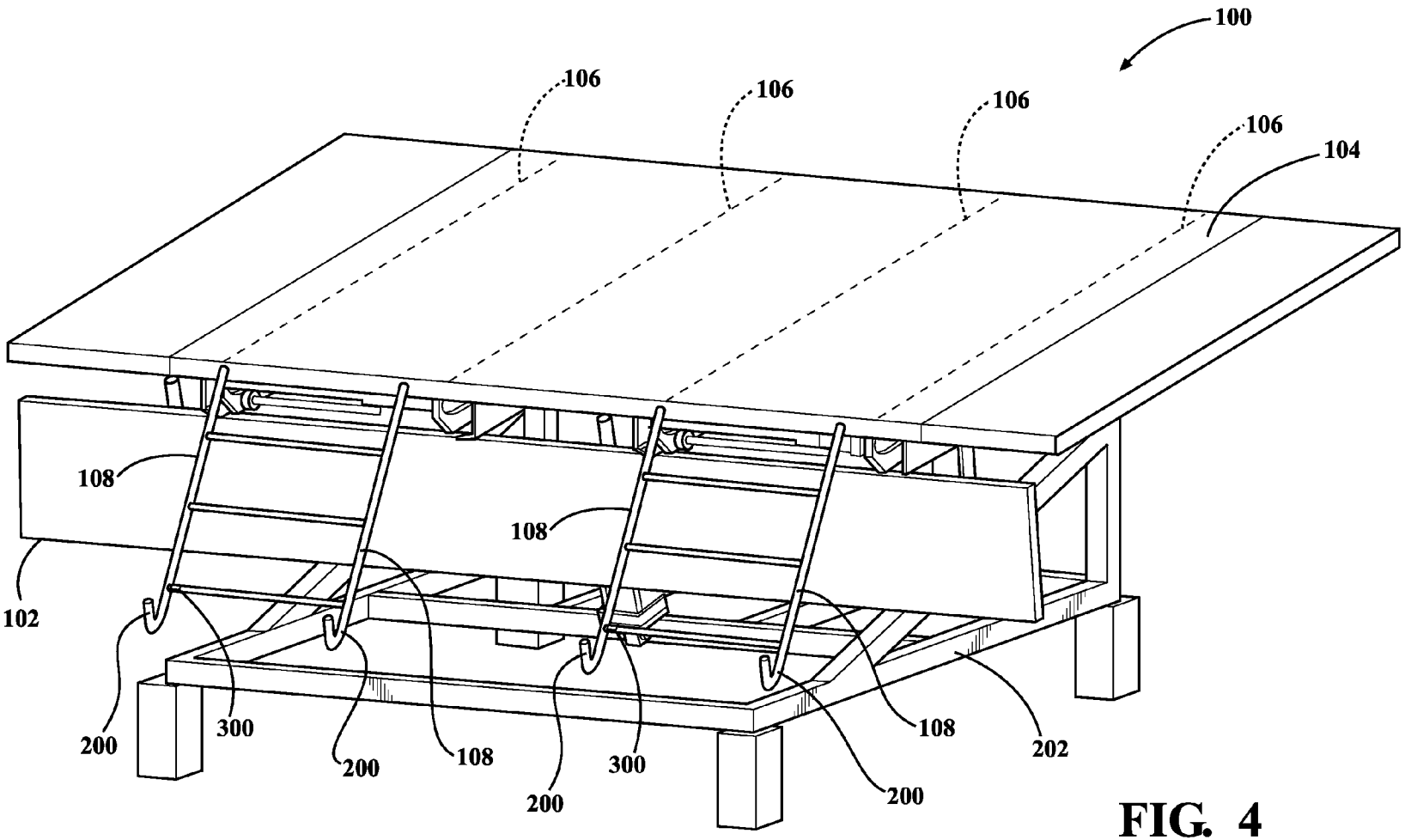
FIG. 4 is a perspective view of the panel unload table of FIG. 1 with a pair of panel fixtures in an unload position.

FIG. 4 is a perspective view of the panel unload table 100 of FIG. 1 with a pair of panel fixtures 108 in the unload position. The unload position can be spaced angularly between the load position and the second position of the table flap 102. The unload position can be optimized depending on both the shape and size of the body panel being unloaded and stored on a finished part pallet or installed on the vehicle and the physical characteristics of the worker unloading the body panel. The load sensors 300 on the panel fixtures 108 can each send a signal to their respective rotary actuator 302 to rotate the panel fixture 108 from the load position to the unload position. The stop surfaces 200 at the lower end of the panel fixtures 108 can assist in holding the body panel in the unload position. An example method of unloading panels using the panel fixtures 108 is described in FIGS. 5 and 6 below.

Figure 5:
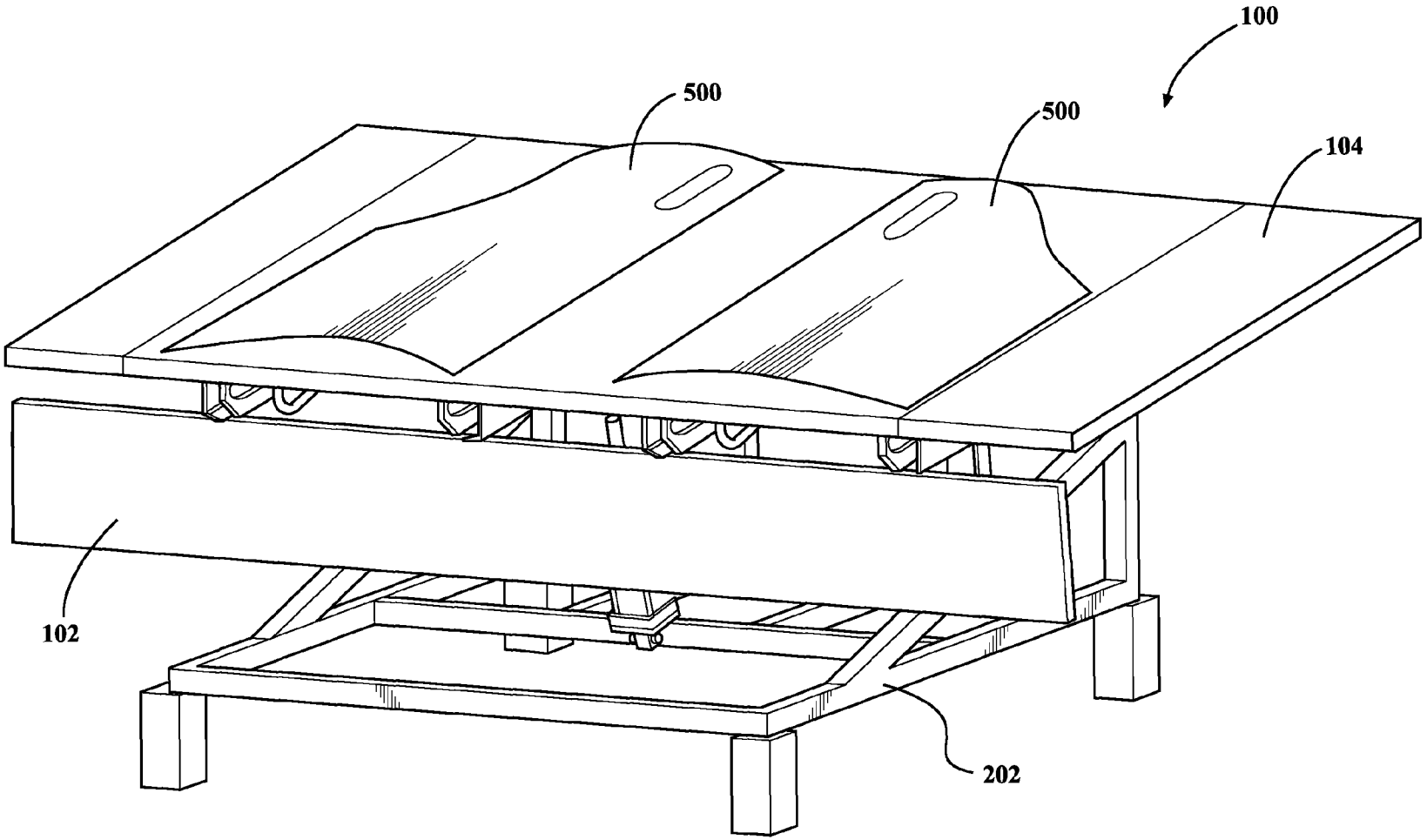
FIG. 5 is a perspective view of the panel unload table of FIG. 1 with a pair of door panels in an inspection position.

FIG. 5 is a perspective view of the panel unload table 100 of FIG. 1 with a pair of door panels 500 in an inspection position. The door panels 500 can be received on the table top 104 and positioned to allow a worker to make an external surface inspection. The table flap 102 can be in the first position, e.g., substantially coplanar with the table top 104, while the door panels 500 are being inspected. After the inspection, the worker can rotate the table flap 102 from the first position to the second position, e.g., substantially perpendicular to the table top 104, to allow the worker, or a different worker, access to the panel fixtures 108 in the stowed position.

The stowed position of the panel fixtures 108 can be substantially parallel to the table top 104. Each panel fixture 108 can be slidably disposed between a pair of slide rails 106, with the slide rails 106 being disposed on a lower surface of the table top 104. After the table flap 102 has been rotated from the first position to the second position, the panel fixtures 108 can be moved from the stowed position to a load position. As shown in FIG. 2, the load position can be substantially coplanar with the table top 104. The panel fixtures 108 can include stop surfaces 200 which can be gripped by a worker to aid the worker in sliding the panel fixtures 108 along the slide rails 106 to move the panel fixtures 108 from the stowed position to the load position.

The next step in the example method of unloading the door panels 500 includes receiving the door panels 500 on the panel fixtures 108 with the door panels 500 being positioned on the panel fixtures 108 in such a manner as to engage a load sensor 300. As described above, the load sensor 300 can be a pneumatic switch or any other sensor capable of recognizing the presence or weight of a door panel 500. Each door panel 500 can be positioned on a panel fixture 108 by a worker sliding the door panel 500 along the surface of the table top 104 and along the surface of the panel fixture 108 until the door panel engages one or more stop surfaces 200 at the end of the panel fixture 108. The table top 104 can also be rotatably coupled to the table base 202 so that the height of the table top 104 can be adjusted to positions suitable for a plurality of workers having varying physical characteristics.

Figure 6:
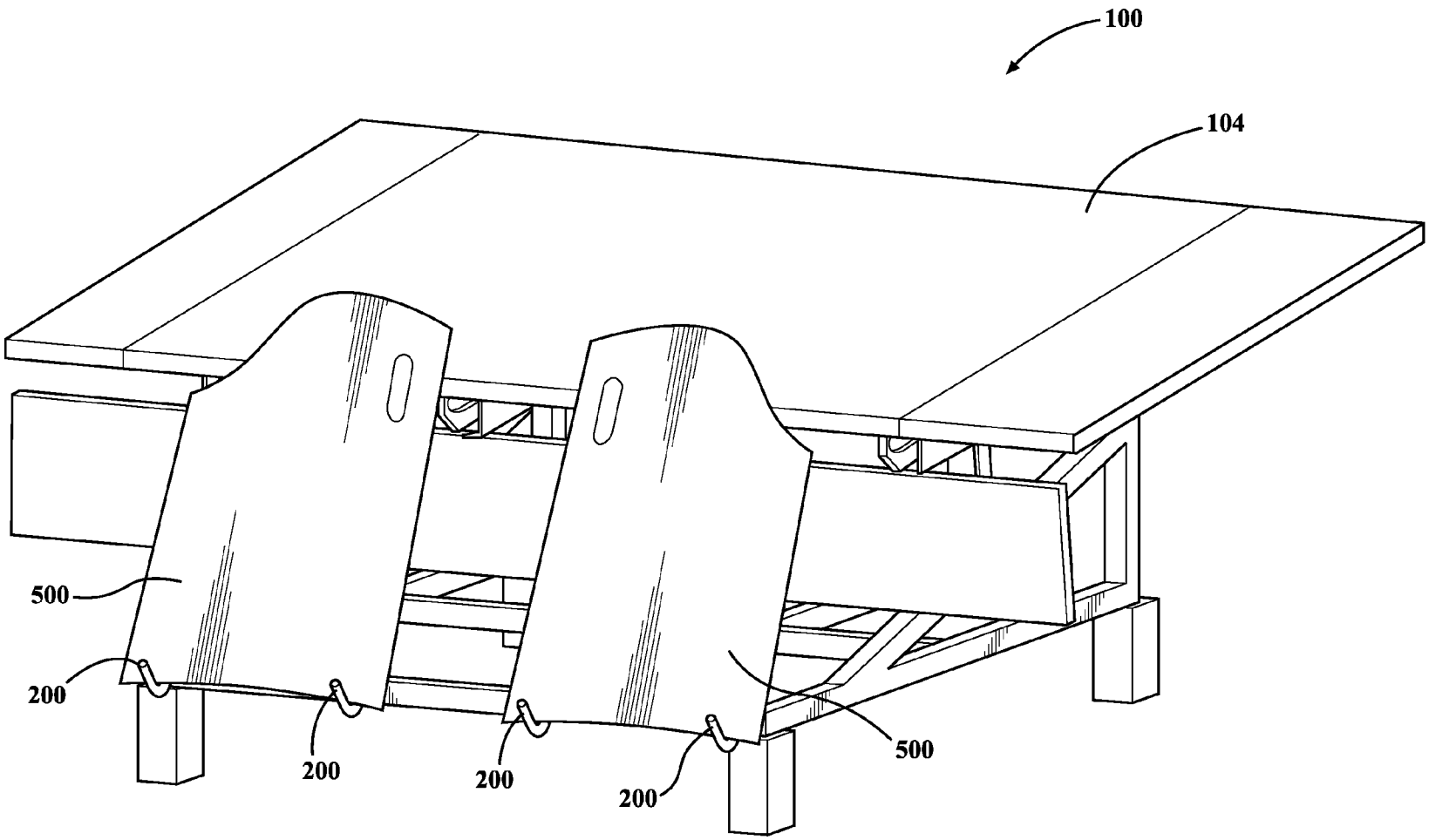
FIG. 6 is a perspective view of the panel unload table of FIG. 1 with a pair of door panels in an unload position.

FIG. 6 is a perspective view of the panel unload table 100 of FIG. 1 with the pair of door panels 500 in an unload position. In response to the load sensor 300 sensing a door panel 500 on a panel fixture 108, the panel fixture 108 can rotate from the load position to an unload position. This rotation can occur in response to the load sensor 300 sending a signal to the rotary actuator 302 to move the panel fixture 108. The unload position, as shown in FIG. 6, can be spaced angularly between the load position and the second, folded position of the table flap 102.

By using the panel fixtures 108 to position the door panels 500 in the unload position, a worker who loads the panels onto the finished part pallets is able to grasp the door panels 500 without bending over the table and without raising his or her arms above the shoulder level, improving the ergonomics of the operation. Without the panel fixtures 108, the worker would be required to bend over the table, and pivot the heavy door panels 500 from the near horizontal surface of the table top 104 to a vertical position in order to unload the door panels 500 from the panel unload table 100. The improvement in ergonomic score using the panel fixtures 108 is over fifty percent when compared to the method of the worker bending over the table and pivoting the door panels 500 into an installation or storage position.

Another benefit of the panel unload table 100 design is the flexibility of using the panel unload table 100 as a traditional tilt-top table with a large table top 104 surface for inspection or storage purposes. The panel fixtures 108 can also be designed to return to the load position after the weight of a body panel has been removed from the panel fixture 108. This return can be based on the load sensor 300 sending a signal to the rotary actuator 302 to move the panel fixture 108 from the unload position back to the load position.

The foregoing description relates to what are presently considered to be the most practical embodiments. It is to be understood, however, that the disclosure is not to be limited to these embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A panel unload table apparatus, comprising:

a table top;

a table flap extending from the table top having a first position and a second position;

a panel fixture rotatable about a pivot axis and having:

a stowed position substantially parallel to the table top;

a load position substantially coplanar with the table top; and an unload position wherein the unload position is spaced angularly between the load position and the second position of the table flap; and a pair of slide rails disposed on a lower surface of the table top wherein the panel fixture is slidably disposed between the slide rails.

2. The apparatus of claim 1 wherein the table flap is rotatably coupled to the table top.

3. The apparatus of claim 2 wherein the table flap is rotated between the first position and the second position to allow a worker access to the panel fixture.

4. The apparatus of claim 1 wherein the panel fixture includes a stop surface for holding a panel in the unload position.

5. The apparatus of claim 1 wherein the panel fixture is moved from the stowed position to the load position by a worker sliding the panel fixture along the pair of slide rails using the stop surface.

6. The apparatus of claim 1, further including:

a load sensor; and a rotary actuator wherein the panel fixture is rotated from the load position to the unload position in response to the load sensor sensing a panel on the panel fixture and sending a signal to the rotary actuator.

7. The apparatus of claim 1 wherein the first position is substantially coplanar with the table top and the second position is substantially perpendicular to the table top.

8. The apparatus of claim 1, further including:

a table base wherein the table top is rotatably coupled to the table base for adjusting the height of the table top for a plurality of workers having varying physical characteristics.

9. A method for unloading a panel, comprising:

receiving the panel on a table top wherein the panel is positioned on the table top to allow a worker to make an external surface inspection;

rotating a table flap extending from the table top from a first position to a second position to allow a worker access to a panel fixture in a stowed position and slidably disposed between a pair of slide rails disposed on a lower surface of the table top;

moving the panel fixture from the stowed position to a load position;

receiving the panel on the panel fixture wherein the panel is positioned on the panel fixture to engage a load sensor; and in response to the load sensor sensing the panel on the panel fixture, rotating the panel fixture from the load position to an unload position.

10. The method of claim 9 wherein the first position is substantially coplanar with the table top and the second position is substantially perpendicular to the table top.

11. The method of claim 9 wherein the stowed position is substantially parallel to the table top.

12. The method of claim 9 wherein the load position is substantially coplanar with the table top.

13. The method of claim 9 wherein the unload position is spaced angularly between the load position and the second position of the table flap.

14. The method of claim 9 wherein the table top is rotatably coupled to a table base for adjusting the height of the table top for a plurality of workers having varying physical characteristics.

15. The method of claim 9 wherein rotating the panel fixture from the load position to an unload position occurs in response to the load sensor sending a signal to a rotary actuator.

16. The method of claim 9 wherein the panel fixture includes a stop surface for holding a panel in the unload position.

17. The method of claim 9 wherein moving the panel fixture from the stowed position to the load position includes sliding the panel fixture along the pair of slide rails using the stop surface.

18. A method for unloading a panel, comprising:

receiving the panel on a table top wherein the panel is positioned on the table top to allow a worker to make an external surface inspection;

rotating a table flap extending from the table top from a first position substantially coplanar with the table top to a second position substantially perpendicular to the table top to allow a worker access to a panel fixture in a stowed position substantially parallel to the table top and slidably disposed between a pair of slide rails disposed on a lower surface of the table top;

moving the panel fixture from the stowed position to a load position substantially coplanar with the table top;

receiving the panel on the panel fixture wherein the panel is positioned on the panel fixture to engage a load sensor; and in response to the load sensor sensing the panel on the panel fixture, rotating the panel fixture from the load position to an unload position spaced angularly between the load position and the second position of the table flap.

* * * * *